US008578896B2

(12) United States Patent
Chassagnoux et al.

(10) Patent No.: US 8,578,896 B2
(45) Date of Patent: Nov. 12, 2013

(54) METHOD FOR BOUNCE SUPPRESSION OF A VALVE SWITCHED BY A PIEZO ACTUATOR

(75) Inventors: Violaine Chassagnoux, Stuttgart (DE); Stefan Schuerg, Ludwigsburg (DE); Wolfgang Stoecklein, Waiblingen (DE)

(73) Assignee: Robert Bosch GmbH, Stuttgart (DE)

( * ) Notice: Subject to any disclaimer, the term of this patent is extended or adjusted under 35 U.S.C. 154(b) by 500 days.

(21) Appl. No.: 12/735,902

(22) PCT Filed: Jan. 26, 2009

(86) PCT No.: PCT/EP2009/050849

§ 371 (c)(1),
(2), (4) Date: Nov. 12, 2010

(87) PCT Pub. No.: WO2009/115360

PCT Pub. Date: Sep. 24, 2009

(65) Prior Publication Data

US 2011/0042594 A1 Feb. 24, 2011

(30) Foreign Application Priority Data

Mar. 18, 2008 (DE) ..... 10 2008 000 731
Jul. 15, 2008 (DE) ..... 10 2008 040 412

(51) Int. Cl.
*F01L 9/04* (2006.01)

(52) U.S. Cl.
USPC ..... 123/90.11; 239/102.2; 251/129.01

(58) Field of Classification Search
USPC ..... 123/90.11; 239/102.2; 251/129.01
See application file for complete search history.

(56) References Cited

U.S. PATENT DOCUMENTS 4,593,658 A 6/1986 Moloney
6,155,500 A * 12/2000 Takase ..... 239/533.3

FOREIGN PATENT DOCUMENTS

| | | |
|---|---|---|
| DE | 199 21 456 | 11/2000 |
| DE | 10 2004 015 002 | 10/2005 |
| EP | 0 995 899 | 4/2000 |
| EP | 1 199 446 | 4/2002 |
| JP | 2002-544424 | 12/2002 |
| JP | 2005-351139 | 12/2005 |
| WO | WO 01/53662 | 7/2001 |
| WO | WO 2006/069750 | 7/2006 |

* cited by examiner

*Primary Examiner* — Ching Chang
(74) *Attorney, Agent, or Firm* — Kenyon & Kenyon LLP

(57) ABSTRACT

A method for bounce suppression of a valve member operated by a piezo actuator during the closing phase of a valve in an internal combustion engine, having the following steps: partial discharging of the piezo actuator, whereby the valve member is braked even before reaching the valve seat, interruption of the discharge of the piezo actuator, whereby the piezo actuator is upset by the valve member and builds up an electric charge, renewed discharging of the piezo actuator, the residual charge after partial discharge and the charge built up during the charge interruption being at least partially dissipated. It is provided, according to the present invention, briefly to interrupt the discharge process, whereby the piezo actuator absorbs the energy of the valve member and, even before an elastic rebound takes place, the piezo actuator is discharged again, in order to dissipate the energy absorbed by the piezo actuator.

15 Claims, 3 Drawing Sheets

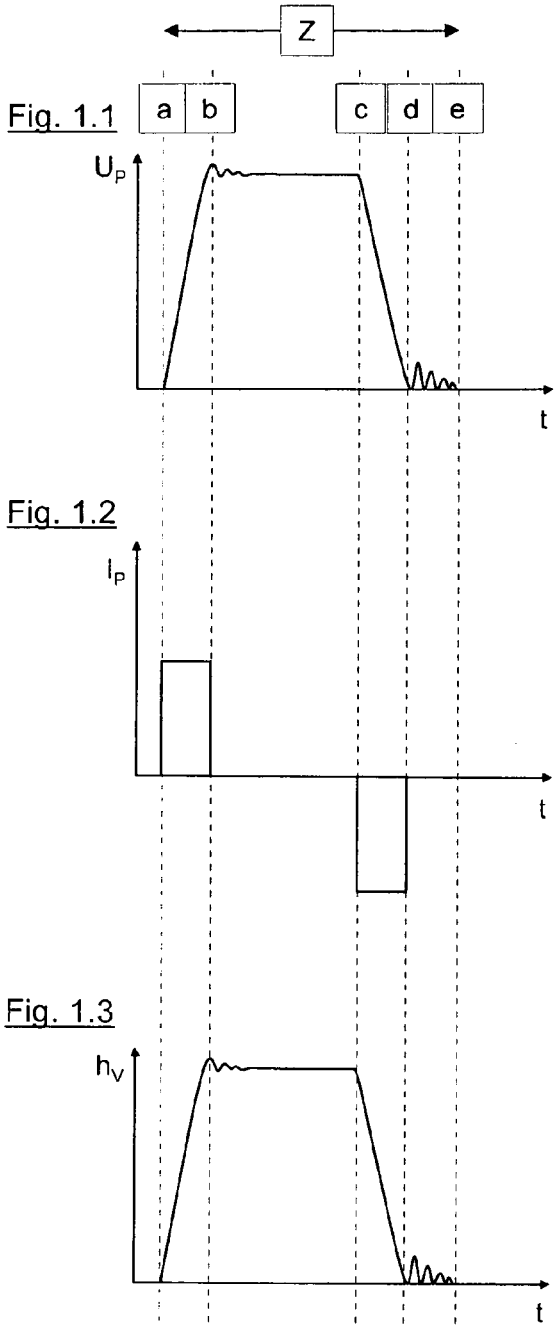
Z
a
b
c
d
e
Fig. 1.1
$U_P$
t
Fig. 1.2
$I_P$
t
Fig. 1.3
$h_V$
t
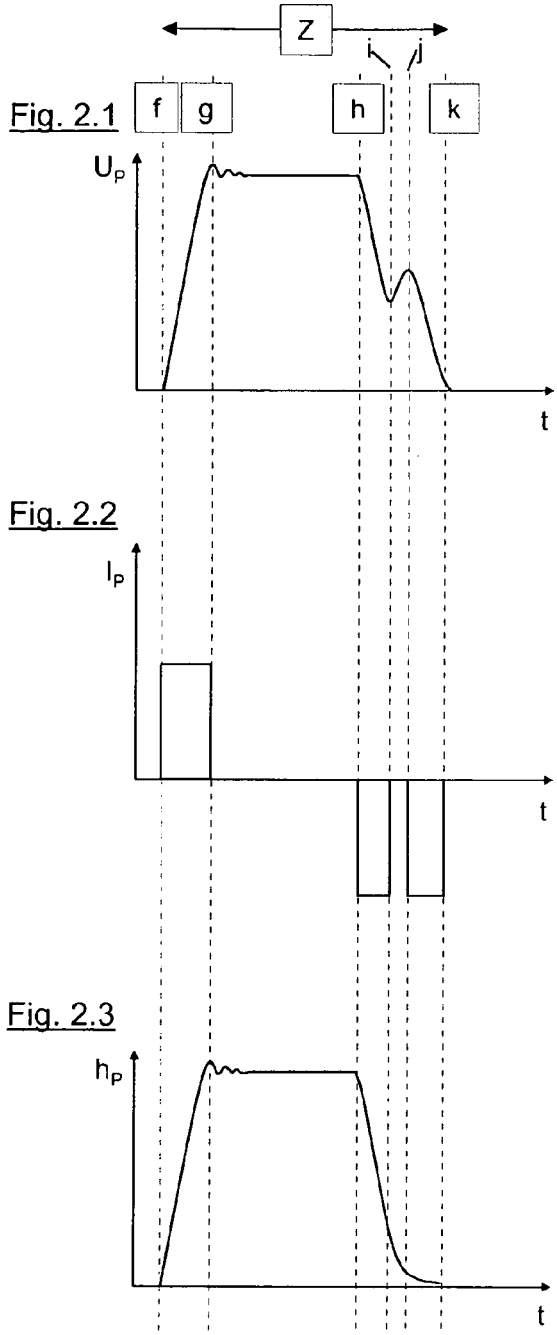
Z
i
j
f
g
h
k
Fig. 2.1
$U_P$
t
Fig. 2.2
$I_P$
t
Fig. 2.3
$h_P$
t

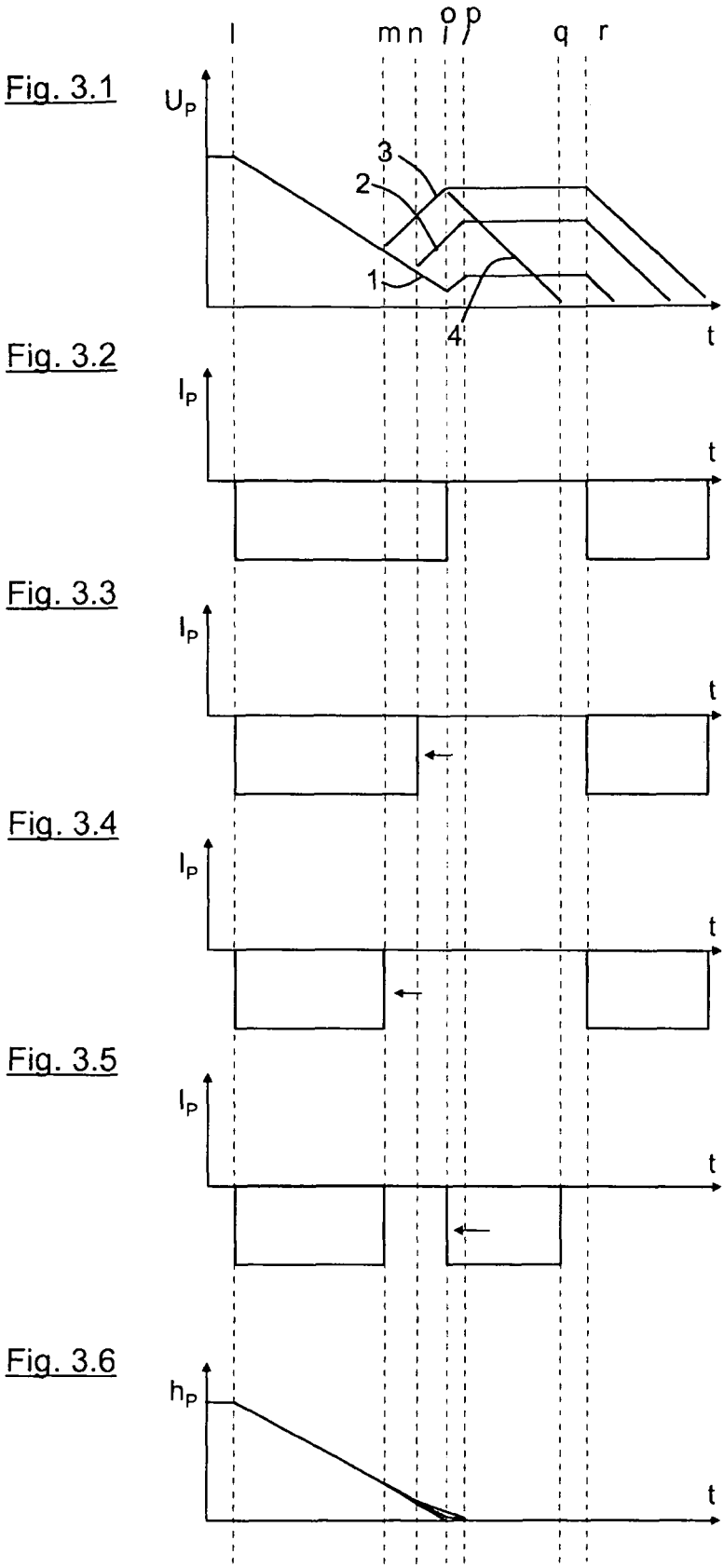
Fig. 3.1
Fig. 3.2
Fig. 3.3
Fig. 3.4
Fig. 3.5
Fig. 3.6
l
m n
o p
q
r
$U_P$
$I_P$
$h_P$
t
1
2
3
4

METHOD FOR BOUNCE SUPPRESSION OF A VALVE SWITCHED BY A PIEZO ACTUATOR

BACKGROUND OF THE INVENTION

1. Field of the Invention

The present invention relates to a method for bounce suppression of a valve member operated by a piezo actuator during the closing phase in an internal combustion engine and a corresponding device for carrying out the method.

2. Description of Related Art

In internal combustion engines, especially in Otto and Diesel engines, valves control the intake and the discharge of the combustion gases, the valve opening and closing times having a considerable influence on the power output, on the fuel consumption, on low-pollutant combustion and on the running properties of the internal combustion engine at a specified rotational speed. These valves are usually developed as flat-seat valves, in the closed state of the valve, a valve member being accommodated with its valve disk in a valve seat in a precisely fitting and sealing manner. To open the valve, the valve disk is lifted off from the valve seat, and in this context, an annular gap opens, through which the combustion gas is able to flow. The flat-seat valve is driven via the valve spindle, which is a part of the valve member. In modern engines, in order to open and close the valves, piezo actuators are used, which open and close again a valve at high speed. In particular during rapid closing of the flat-seat valve, the valve disk bumps into the valve seat, the sealing surfaces of the two elements striking each other. At higher closing speeds, the impact of the valve disk onto the valve seat leads to an elastic bump, as a result of which the flat-seat valve does not close abruptly, but rather opens slightly and closes again several times after the first closing. This impacting impairs the precision of the closing process, and thereby influences the abovementioned properties of the internal combustion engine in an undesired way. Furthermore, the impacting of the valve disk on the valve seat leads to rapid material wear. In particular, the exhaust valve of an internal combustion engine is especially exposed to corrosive conditions, because the sealing surfaces on the valve disk and the valve seat are exposed to high temperatures and the corrosive effects of the hot and combusted combustion gases.

BRIEF SUMMARY OF THE INVENTION

The present invention provides a method for bounce suppression of a valve member operated by a piezo actuator during the closing phase in an internal combustion engine and a corresponding device for carrying out the method.

According to the present invention, the piezo actuator is electronically controlled in such a way that, during the closing process, first of all it absorbs the kinetic energy of the valve member shortly before impact, is thereby deformed itself, generates a charge internally, and with that, it increases its restoring force. Even before the piezo actuator goes over into the elastic rebound phase, the charge built up internally in the piezo actuator is dissipated, so that the valve member is finally damped by an inelastic bump upon impact and guided into the valve seat having lower kinetic energy, where the valve disk then remains, without the undesired bouncing motion.

The method according to the present invention, during the closing phase, includes the steps: partial discharging of the piezo actuator, whereby the valve member is braked even before reaching the valve seat, interruption of the discharge of the piezo actuator, whereby the piezo actuator is upset by the valve member and builds up an electric charge, renewed discharging of the piezo actuator, a residual charge remaining in the piezo actuator is at least partially dissipated after partial discharge and the charge built up during the charge interruption. The method, according to the present invention, for bounce suppression of a valve member operated by a piezo actuator, during the closing phase in an internal combustion engine, also includes an interruption of the discharge process of the piezo actuator during closing of the valve, the selection of the points in time of the start of the interruption and the end of the interruption being significant for optimum bounce suppression.

In the embodiment of the present invention, it is alternatively also possible to repeat the process within a valve-closing cycle once or several times, whereby the valve member is returned into the valve seat in a stuttering manner. Each discharge process is interrupted in a controlled manner, in this context. During the respective interruption times, the valve member has a closing speed determined by the interruption time period, and this speed, as well as the mass of the valve member, determine the kinetic energy of the valve member. Beginning at the time of the interruption, the valve member, which is connected in a directly or indirectly force-locking manner to the piezo actuator, is braked via the elastic effect of the piezo actuator. During the braking, the piezo actuator is deformed by the impulse of the valve member, and in the process, the piezo crystal in the piezo actuator builds up a charging voltage which increases the restoring force of the piezo crystal. Even before the piezo crystal gets into the back swing, and therefore acts itself as an impact surface instead of the valve seat, the charge built up in the piezo actuator is discharged. Because of the discharge, the piezo actuator, that is mechanically stressed by the kinetic energy of the valve member, loses its restoring force, whereby the elastic back swing does not take place. This being the case, during the interruption of the discharge, the piezo actuator acts like an impact cushion, in which the kinetic energy is converted into deformation energy and is dissipated.

BRIEF DESCRIPTION OF THE SEVERAL VIEWS OF THE DRAWINGS

In the following, the present invention is explained in detail with reference to the attached drawings. The figures show:

FIG. 1.1 shows a diagram of the charging voltage curve of an undamped piezo actuator over one valve cycle.

FIG. 1.2 shows a diagram of the charging current and discharging current of an undamped piezo actuator over the same valve cycle.

FIG. 1.3 shows a diagram of the valve lift of an undamped piezo actuator over one valve cycle.

FIG. 2.1 shows a diagram of the charging voltage curve of a piezo actuator using the method according to the present invention for bounce suppression.

FIG. 2.2 shows a diagram of the charging current and the discharging current of a piezo actuator over the valve cycle according to FIG. 2.1.

FIG. 2.3 shows a diagram of the valve lift having bounce suppression according to the present invention.

FIGS. 3.1-3.6 show a diagram for clarifying the automatic setting of the discharge interruption times.

DETAILED DESCRIPTION OF THE INVENTION

Figure 4:
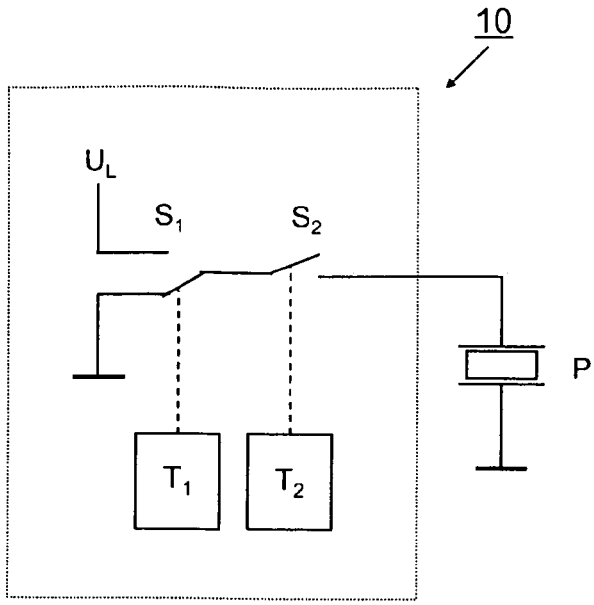
FIG. 4 shows a block diagram of a simple device for charging, and discharging according to the present invention, a piezo actuator.

FIG. 1 shows a diagram of the curve over time of charging voltage $U_p$ of a piezo actuator over a valve cycle Z along time t. Starting at time a in the diagram in FIG. 1.3, at which the piezo actuator is not charged and the valve is closed, valve lift $h_v$ at time a thus amounting to zero, charging current $I_p$ begins to flow, according to the diagram in FIG. 1.2. Charging current $I_p$ flows as a constant current from time a to time b. Within this time interval a-b, the piezo actuator builds up charging voltage $U_p$ at time b in the diagram in FIG. 1.1. Because of the unbraked extension, and because of the masses connected with force-locking to the piezo actuator, the valve member still vibrates back and forth about the opening point at time b and shortly thereafter, according to the diagram in FIG. 1.3. This mechanical vibration is reflected in charging voltage $U_p$ in charging voltage diagram in FIG. 1.1. The valve, now opened, remains in the open position of time b until time c. Within this time interval b-c, neither valve lift $h_v$, nor charging voltage $U_p$, nor charging current and discharging current $I_p$ changes, apart from the slight mechanical vibrations of valve lift $h_v$ mentioned at the outset, and charging voltage $U_p$ corresponding to it. At time c, the piezo actuator is discharged by negative current pulse $I_p$, which sets in at time c (FIG. 1.2), from time c to time d. Within this time interval c-d, valve lift $h_v$ follows the negative leg in FIG. 1.3 between times c and d. At time d, according to the diagram in FIG. 1.3, the valve member arrives at lift height zero, which means the same as the impact of the valve disk on the valve seat, where it is then bumped back elastically against the restoring force of a valve spring or of the piezo actuator, and still strikes several times and is thrown back elastically, until this bouncing vibration has ebbed out at point e in the diagram in FIG. 1.3 This bouncing vibration taking place-after the closing is reflected in the curve of charging voltage $U_p$ of the piezo actuator in the diagram in FIG. 1.1. It is the subject matter of the present invention to suppress this bouncing vibration between times d and e after the end of the discharge process.

FIGS. 2.1, 2.2 and 2.3 show the corresponding curve of charging voltage $U_p$ of the piezo actuator in FIG. 2.1, the curve of the discharge current in FIG. 2.2 and valve lift $h_v$ over a valve cycle Z, the discharge of the piezo actuator being interrupted according to the present invention. The interruption is shown on the right side of the diagram in FIG. 2.2. The valve cycle begins at time f, as in FIGS. 1.1, 1.2 and 1.3 at point a, and runs via time g to time h. At this point, cycle part f-g-h in FIGS. 2.1, 2.2 and 2.3 does not differ from cycle part a-b-c in FIGS. 1.1, 1.2 and 1.3. Beginning at point h, the discharge process of the piezo actuator begins by a first negative discharge current pulse according to the diagram in FIG. 2.2 of time h to time i. Within this time interval h-i, charging voltage $U_p$ of the piezo actuator drops off to approximately one-half to one-third of the maximum charging voltage, according to the diagram in FIG. 2.1. In a corresponding manner, valve lift $h_v$ in FIG. 2.3 also decreases to about one-half to one-third of the maximum lift. At this point, at time i, discharge current $I_p$ (FIG. 2.2) is interrupted. Following this, the piezo actuator is not discharged any further, and, from now on, it is further deformed by the kinetic energy of the valve member. Because of the deformation, that is, the further upsetting by the braked valve member mass, the piezo actuator builds up charge and increases its charging voltage $U_p$ in time interval i to j (FIG. 2.1). This increase in charging voltage $U_p$ increases the restoring force of the piezo actuator, whereby the valve member is braked increasingly more strongly. Thus, the piezo actuator absorbs the kinetic energy of the valve member. The energy absorption is limited by the capacitance of the piezo actuator, that is, the maximum possible charging buildup within the piezo actuator. If this is sufficient to stop the valve completely for a while, then at this point the mechanical stress and the charging of the piezo actuator would lead to the piezo actuator carrying out a back swing during the reduction of the mechanical stress and the reduction of the internal charge. But, exactly at this point, at time j, the internal charge of the piezo actuator is dissipated by a renewed discharge current pulse (FIG. 2.2) in time interval j-k, so that the back swing is prevented. Between time j and k, the valve member is again brought to a reduction in the valve lift, by the discharge of the piezo actuator. Depending on the intensity of the renewed acceleration or the kinetic energy still residually bound in the valve member, this renewed discharge and the renewed return stroke lead to a gentler impact of the valve disk onto the seat, without one or more rebounds taking place on account of this.

FIGS. 3.1, 3.2, 3.3, 3.4, 3.5 and 3.6 show how a device for bounce suppression finds the right time of the interruption of the charging process and the right time for a renewed discharge of the piezo actuator. On this matter, FIG. 3.1 shows a set of diagrams of four curves of charging voltage $U_p$ of the piezo actuator, curve 1 in FIG. 3.1 being associated with the discharge diagram in FIG. 3.2, curve 2 being associated with the discharge diagram in FIG. 3.3, curve 3 being associated with the discharge diagram in FIG. 3.4 and curve 4 being associated with the discharge diagram in FIG. 3.5. The valve lift corresponding to the curves is shown i the diagram in FIG. 3.6.

Beginning with curve 1 in FIG. 3.1, the first discharge process, that is not yet optimized, starts at time 1 and the discharge pulse lasts until time o, according to FIG. 3.2. Because of this long discharge pulse, the valve member builds up a high kinetic energy and upsets the piezo actuator, that is for the most part discharged, up to a maximum upset and up to the maximum charge buildup possible from this level of mechanical stress of the piezo actuator, corresponding to charging voltage $U_p$. The renewed energy-absorbing charge buildup is too small, however, to soften the kinetic energy of the valve member. It is therefore necessary to shorten the first discharge pulse, so that the charge still possible to be built up by upset of the piezo actuator, at the end of the first discharge pulse, is raised to a minimum level. In this non-optimized discharge process according to curve 1 in FIG. 3.1, a new discharge pulse begins only at time r, by which charging voltage $U_p$, which was formerly at a stable level in time, is decreased. This level in time interval p-r is specifically to be avoided, however, and is therefore detected by a control electronics system, and the first discharge pulse is thereupon shortened in the next valve cycle.

During the next valve cycle, the discharge process begins again at time 1, but is interrupted earlier than at time o, namely, at time n. The charge buildup then taking place in curve 2, after time n, is correspondingly greater than after time o in curve 1, because the piezo actuator still has sufficient capacitance for charge buildup and for mechanical upsetting. Thereafter, the same circumstances set in while a plateau in time forms in charging voltage $U_p$, as in curve 1 of charging voltage $U_p$.

In a still later valve cycle, the discharge diagram is shown in FIG. 3.4, the curve of charging voltage $U_p$ is shown in curve 3 in FIG. 3.1, charging voltage $U_p$ rises, beginning at time m, to the level at time o in FIG. 3.1, after the discharge current has been interrupted at time o. This charge buildup, represented by the rise in charging voltage $U_p$ in curve 3, is now great enough to absorb the kinetic energy bound to the valve member, the amount of the sufficient kinetic energy being predetermined, and cannot be derived from the diagram of the charging voltage curve itself.

In order to suppress the development of the level remaining the same in time, the second discharge pulse is advanced, at this point, to such an extent that directly after the maximum buildup of the charging voltage at time o, curve 4 in FIG. 3.1 and discharge diagram 3.5, the renewed discharge of the piezo actuator begins, and charging voltage $U_p$ drops off again immediately to a minimum.

During the optimizing phase, the curves of valve lifts $h_v$ do not differ greatly from one another. The stress absorbed by the piezo actuator, however, does differ. In response to the optimized discharge, the piezo actuator is stressed in the elastic range and is destressed again.

FIG. 4 finally shows a device 10, according to the present invention, for discharging a piezo actuator P, which has a charge/discharge switch $S_1$ and a switch $S_2$ for interrupting the charging process. During discharge of piezo actuator P by switch $S_1$, switch $S_2$ interrupts the charging process, in order to damp the impact of the valve member. Alternatively, instead of using two switches $S_1$ and $S_2$, it is also possible to use a single switch having 3 states, which charges piezo actuator P in a first state, is highly resistive in the second state and discharges piezo actuator P in a third state.

Figure 5:
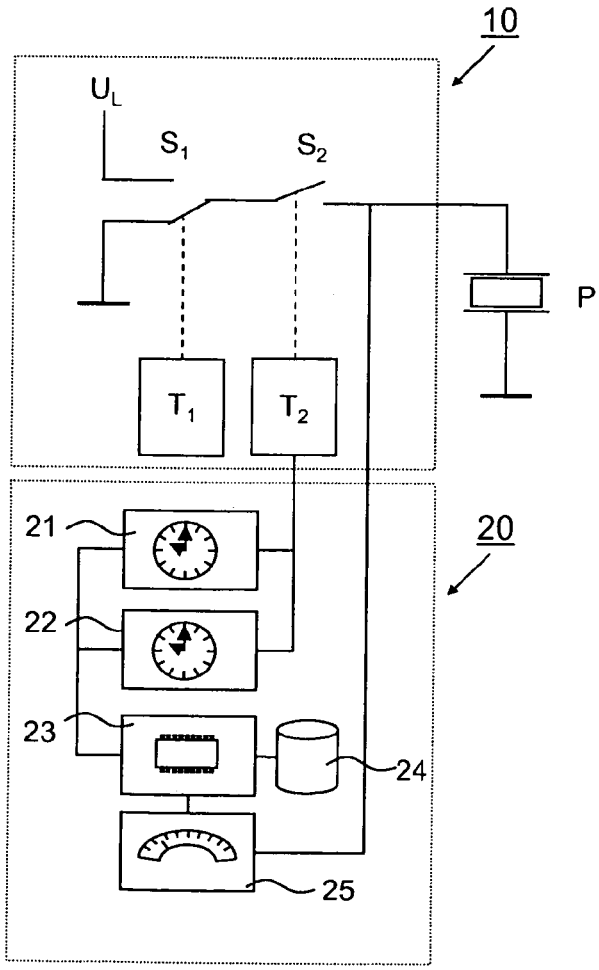
FIG. 5 shows a block diagram of a control device as an additional embodiment of the device according to FIG. 4.

As is shown in FIG. 5, for the automatic setting of the times of the discharge current pulse, a control device 20 is used in the embodiment of device 10 which monitors the charging voltage of piezo actuator P. Control device 20 for controlling a piezo actuator P for a valve member in an internal combustion engine has the following components to do this: at least one variable timing element 21 for setting a point in time for interrupting the discharge process of piezo actuator P, at least one variable timing element 22 for setting a point in time for renewed charging after interrupting the discharge of piezo actuator P, at least one device 25 for measuring the charging voltage of piezo actuator P, at least one device 24 for storing the measured data and at least one device 23 for the automatic variation of the time elements.

For the setting of the discharge current times, control device 20 detects a rise in the charging voltage of piezo actuator P after the interruption of the first discharge current, and measures the height of the charging voltage rise. Only when the height of the charging voltage rise reaches or exceeds a predetermined value does control electronics 20 control the point in time of the renewed discharge pulse, control device 20 in this case detecting a plateau development over time, and advancing in time the second discharge pulse in successive valve cycles until the plateau development of the charging voltage fails to appear. In order to set the two points in time, control device 20 controls the points in time according to the following strategy: First, the setting of the time of the first interruption takes place after a partial discharge by control device 20, so that the interruption takes place so late that the upsetting of piezo actuator P, taking place after the interruption, is so slight that the accompanying charge buildup falls below a specified value. This ensures that control device 20 does not close the valve member at too early a closing time. Then the setting of the time of the renewed discharge by control device 20 begins so that the renewed discharge takes place so late that the charge of piezo actuator P, built up by upsetting, does not change over a specified time interval. A plateau over time is detected by this, which is minimized in the subsequent control cycle. From this non-optimal state, the control device controls the point in time again by the subsequent adjustment of the point in time of the interruption after a partial discharge, until it has been advanced in time so far that the charge buildup reaches or exceeds a specified value. Only after that does the adjusting of the point in time of the renewed discharge take place, until it has been advanced so far that the charge of the piezo actuator, built up by the upsetting, changes within a specified time interval by a specified amount, so that no plateau formation over time is detected.

Control device 20 used for the control, in an advantageous manner has a device which detects the impact of the valve member, preferably via the monitoring of the charging voltage after the discharge of piezo actuator P. When an impact is detected, control device 20 is activated for setting the discharge time, and if no further impact is detected, control device 20 is deactivated.

For the implementation of control device 20, a microcontroller 23 may be used or a control electronics system, the input of the control devices being the charging voltage and the output being a signal for triggering the discharge process.

What is claimed is:

1. A method for bounce suppression of a valve member operated by a piezo actuator during a closing phase of a valve having a valve seat in an internal combustion engine, comprising:

partially discharging the piezo actuator using a first discharge pulse, whereby a residual charge is left after a termination of the first discharge pulse and the valve member is braked before reaching the valve seat;

at a first point in time, interrupting the discharging of the piezo actuator by terminating the first discharge pulse, in response to which interruption the piezo actuator is upset by the valve member and, as a result of the upset, builds up an electric charge;

at a second point in time, renewing discharge of the piezo actuator using a second discharge pulse, the residual charge left after partial discharge and the electrical charge built up during the charge interruption being at least partially dissipated as a result of the renewed discharge; and selecting the first point in time so that the electric charge exceeds a first specified value required for the piezo actuator to absorb a predetermined amount of kinetic energy of the valve member.

2. The method as recited in claim 1, further comprising:

repeating at least once a cycle of said partially discharging, said interrupting of the discharging and said renewing discharge, until the valve member reaches the valve seat, wherein the valve stutters as a result of the repeating.

3. The method as recited in claim 2, wherein at least one of the first point in time and the second point in time is varied by a control device.

4. The method as recited in claim 3, wherein a charging voltage of the piezo actuator is monitored by the control device.

5. The method as recited in claim 2, wherein the first and the second points in time for successive cycles are set one after the other.

6. The method as recited in claim 1, wherein at least one of the first point in time and the second point in time is varied by a control device.

7. The method as recited in claim 6, wherein a charging voltage of the piezo actuator is monitored by the control device.

8. The method as recited in claim 6, further comprising performing the following over more than one valve cycle;

a) setting of the first point in time by the control device, so that the accompanying electric charge buildup falls below a second specified value;

b) setting of the second point in time by the control device, so that the electric charge of the piezo actuator, built up by upsetting, does not change over a first specified time interval;

c) following a and b, advancing the first point in time until the electric charge buildup reaches or exceeds the first specified value; and d) following c, advancing the second point in time until the electric charge of the piezo actuator, built up by upsetting, changes over a second specified time interval by a specified amount.

9. A control device for controlling a piezo actuator for a valve in an internal combustion engine, comprising:

at least one device for discharging the piezo actuator using a first discharge pulse;

at least one device for interrupting the discharge process of the piezo actuator within one discharge cycle by terminating the first discharge pulse at a first point in time;

at least one variable timing element for setting the first point in time, wherein the first point in time is selected by the control device so that an electric charge built up in the piezo actuator when the piezo actuator is upset by the valve member in response to the interruption of the discharge, exceeds a first specified value required for the piezo actuator to absorb a predetermined amount of kinetic energy of the valve member; and at least one variable timing element for setting a second point in time for a renewed discharge after the interruption of the discharge.

10. The control device as recited in claim 9, further comprising:

at least one device for measuring a charging voltage of the piezo actuator;

at least one device for storing the measured charging voltage; and at least one device for automatic variation of the timing elements, the device for the automatic variation of the timing elements varying the first and the second points in time by performing the following:

a) setting of the first point in time so that the accompanying electric charge buildup falls below a second specified value;

b) setting of the second point in time by the control device, so that the electric charge of the piezo actuator, built up by upsetting, does not change over a first specified time interval;

c) following a and b, advancing the first point in time until the electric charge buildup reaches or exceeds the first specified value; and d) following c, advancing the second point in time until the electric charge of the piezo actuator, built up by upsetting, changes over a second specified time interval by a specified amount.

11. The control device as recited in claim 10, wherein the at least one device for the automatic variation of the timing elements is a control electronics system.

12. The control device as recited in claim 10, wherein the at least one device for the automatic variation of the timing elements is a microcontroller.

13. The control device as recited in claim 10, further comprising a device for detecting valve impact which, in response to positive detection of the valve impact, activates the device for the automatic variation of the timing elements or which, in response to negative detection of the valve impact, deactivates the device for the automatic variation of the timing elements.

14. The control device as recited in claim 11, further comprising a device for detecting valve impact which, in response to positive detection of the valve impact, activates the device for the automatic variation of the timing elements or in response to negative detection of the valve impact, deactivates the device for the automatic variation of the timing elements.

15. The control device as recited in claim 12, further comprising a device for detecting valve impact which, in response to positive detection of the valve impact, activates the device for the automatic variation of the timing elements or in response to negative detection of the valve impact, deactivates the device for the automatic variation of the timing elements.

* * * * *

UNITED STATES PATENT AND TRADEMARK OFFICE

CERTIFICATE OF CORRECTION

PATENT NO. : 8,578,896 B2
APPLICATION NO. : 12/735902
DATED : November 12, 2013
INVENTOR(S) : Chassagnoux et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 553 days.

Signed and Sealed this
Twenty-second Day of September, 2015

Michelle K. Lee

Michelle K. Lee
*Director of the United States Patent and Trademark Office*